US006660402B2

(12) United States Patent
Tanabe

(10) Patent No.: US 6,660,402 B2
(45) Date of Patent: Dec. 9, 2003

(54) METAL SUBSTRATE

(75) Inventor: Hiroshi Tanabe, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/242,432

(22) Filed: Sep. 13, 2002

(65) Prior Publication Data

US 2003/0068516 A1 Apr. 10, 2003

(30) Foreign Application Priority Data

Sep. 14, 2001 (JP) ..... 2001-280532

(51) Int. Cl.[7] ..... B32B 3/12; B01J 35/04
(52) U.S. Cl. ..... 428/593; 422/180; 502/527.22
(58) Field of Search ..... 428/593, 603; 422/180; 502/527.22, 439

(56) References Cited

U.S. PATENT DOCUMENTS 3,532,157 A * 10/1970 Hubble ..... 165/8
4,098,722 A * 7/1978 Cairns et al. ..... 502/336
4,818,746 A * 4/1989 Cyron ..... 502/439
4,845,073 A * 7/1989 Cyron ..... 502/439
5,068,218 A * 11/1991 Nishizawa ..... 502/439
5,103,641 A * 4/1992 Maus et al. ..... 60/299
5,118,477 A * 6/1992 Takikawa et al. ..... 422/179
5,468,455 A * 11/1995 Bruck ..... 422/180
6,475,446 B1 * 11/2002 Horiike et al. ..... 422/180

OTHER PUBLICATIONS

Yasuhiro Mita, New Concept Applied Metal Substrate for Automotive Catalytic Converter, Calsonic World, Jun. 28, 1999, pp. 22–27, vol. 6, Engineering Planning Division of Calsonic Corporation, Tokyo, Japan.

* cited by examiner

*Primary Examiner*—John J. Zimmerman
(74) *Attorney, Agent, or Firm*—Foley & Lardner

(57) ABSTRACT

A honeycomb structure brazed with an outer casing has a large corrugated foil and a small corrugated foil overlapped and wound alternately and formed like a cylinder by diffused junction. The large corrugated foil and the small corrugated foil has 20 $\mu$m in thickness. The honeycomb structure has 900 cells/square inches in cell density. The large corrugated foil has a wave height of 0.81 mm and a pitch of 1.71 mm. The small corrugated foil has a wave height of 0.05 mm to 0.18 mm and a pitch of 1.29 mm to 1.39 mm. Whereby the produced stress in each corrugated foil upon thermal expansion is reduced.

7 Claims, 9 Drawing Sheets

FIG. 8

| PLATE THICKNESS (μ)/ CELL DENSITY (/SQUARE INCHES) | 30/600 | 30/900 | 20/900 |
|---|---|---|---|
| SURFACE AREA ($cm^2/cm^3$) | 47 | 58 | 59 |
| HEAT CAPACITY (CAL/°C) PER 1ℓ | 67 | 81 | 54 |

METAL SUBSTRATE

BACKGROUND OF THE INVENTION

1. Field of the Invention

The present invention relates to a structure of a metal substrate installed in an exhaust system of a vehicle.

2. Description of the Related Art

In the exhaust system of the vehicle, a metal substrate for carrying a catalyst for oxidizing or reducing the harmful components in an exhaust gas is installed. Many metal substrates have been up to now proposed in which a large corrugated foil having relatively large corrugations and a small corrugated foil having small corrugations are overlapped and wound alternately.

This metal substrate has a number of cells formed between each corrugated foil to keep a contact area with the exhaust gas. The corrugated foil may be typically made from a foil material of 20Cr—5Al—Fe having a thickness of 30 to 50 $\mu$m in consideration of resistance to oxidation. The corrugated foils are connected by brazing of nickel (Ni) so that the cell density is 600 cells/square inches at maximum.

However, in the metal substrate according to the related art, since the corrugated foils are connected by brazing of nickel, base materials Al and Cr are diffused into a fillet of nickel brazing material, while the brazing material Ni is immersed into the base materials. Therefore, Al and Cr in the foil material of corrugated foils are consequently diluted, resulting in a problem that the resistance to oxidation is decreased.

Along with an enhanced requirement performance of exhaust emission purification, there is need for increasing the contact area with the exhaust gas on a carrying surface of catalyst by increasing the cell density in the metal substrate in which the corrugated foils are overlapped and wound as described above. However, if the cell density was further increased using the materials according to the related art, it was found that the expected exhaust emission purification effect could not be obtained at the low temperatures at the early stage of starting the operation.

The reason is that rise in temperature over the entire area of the metal substrate is slower than conventionally. That is, with the higher cell density, the surface area is increased, but the number of winding the corrugated foil is also increased, so that the mass and heat capacity thereof are increased to delay the rise in temperature over the entire area of the metal substrate.

SUMMARY OF THE INVENTION

In the light of the above-mentioned problems, it is an object of the present invention to provide a metal substrate in which the exhaust emission purification performance is further improved by making the cell density higher while suppressing the heat capacity to be low.

According to a first aspect of the invention, there is provided a metal substrate having an outer casing and a honeycomb structure formed by overlapping and winding a large corrugated foil and a small corrugated foil, the honeycomb structure held in the outer casing. The large corrugated foil and the small corrugated foil have thickness in a range of 18 $\mu$m to 22 $\mu$m. The honeycomb structure has cell density in a range of 810 cells/square inches to 990 cells/square inches.

According to a second aspect of the invention, the large corrugated foil and the small corrugated foil in the honeycomb structure are connected by diffused junction.

According to a third aspect of the invention, the large corrugated foil has a wave height in a range of 0.76 mm to 0.86 mm and a pitch in a range of 1.66 mm to 1.76 mm. The small corrugated foil has a wave height in a range of 0.05 mm to 0.18 mm and a pitch in a range of 1.29 mm to 1.39 mm.

According to a fourth aspect of the invention, the small corrugated foil is overlapped and wound around an outermost circumference of the honeycomb structure multiple times.

According to a fifth aspect of the invention, the honeycomb structure is brazed with an inner circumferential face of the outer casing by a brazing foil disposed in an area spaced away a predetermined distance from a back end face of the honeycomb structure on a rear-half side in a flow direction of exhaust gas.

According to a sixth aspect of the invention, the outer casing is formed with a radially outwardly swollen bead around the entire circumference of the outer casing on an opposite side to the rear end face of the honeycomb structure, with the brazing foil before brazing sandwiched.

BRIEF DESCRIPTION OF THE DRAWINGS

FIG. 8 is a table showing variations in the surface area and heat capacity with respect to the plate thickness of corrugated foil and cell density thereof.

DETAILED DESCRIPTION OF THE PREFERRED EMBODIMENTS

The preferred embodiments of the present invention will be described below.

Figure 1:
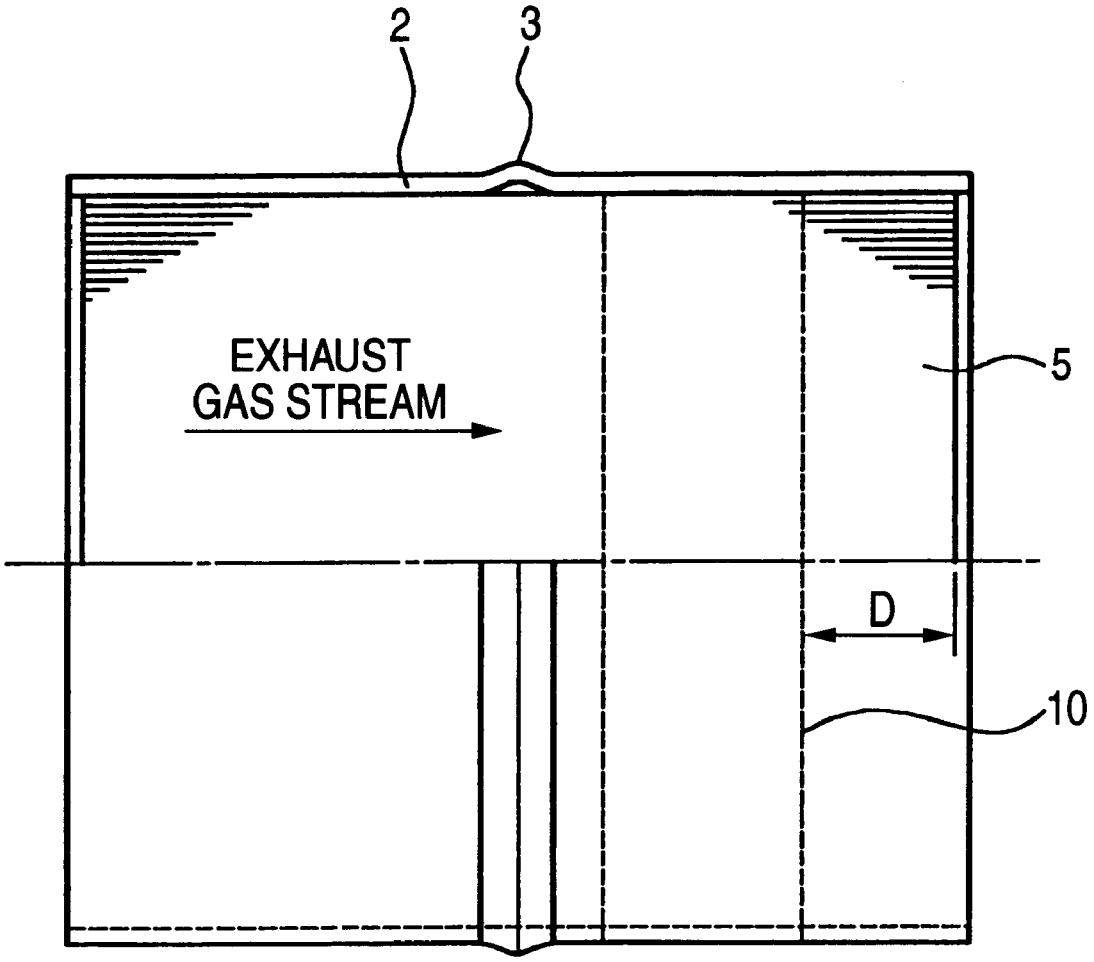
FIG. 1 is a view illustrating a metal substrate according to an embodiment of the present invention.

FIG. 1 is a structure view of a metal substrate according to an embodiment of the present invention, in which an upper half part above an axial center line as indicated by a dashed line is a longitudinal section and a lower half part is an outside face.

An outer casing 2 is made of stainless material (SUS) having a thickness of 2 mm and formed into a cylindrical shape having a length of about 115 mm and an outer diameter of 106 mm. At a central position of the outer casing 2 in the axial (longitudinal) direction, a bead 3 swollen radially outwardly having about 10 mm in width is formed around the entire circumference.

A honeycomb structure 5 having a length of 110 m is inserted into the inside of the outer casing 2. Both ends of the honeycomb structure 5 is retracted inside the end faces of the outer casing 2. To prevent damage on both end faces of the honeycomb structure 5.

The outer circumferential face of the honeycomb structure 5 is brazed with the inner circumferential face of the outer casing 2 on the rear half side of the outer casing 2 in a direction of exhaust gas stream. The brazing is performed while a brazing foil material 10 having a width of about 25 mm is placed around the entire circumference closer to the bead 3 centrally disposed. A gap D of 17 mm is provided between a rear end face of the honeycomb structure 5 and the brazing foil material 10. Thereby, run off of brazing filler due to heating at the time of brazing is blocked by the bead portion 3, and it is prevented that the brazing filler is flown out to the end face.

The honeycomb structure 5 is formed like a cylinder by overlapping and winding a large corrugated foil 7 having large corrugations and a small corrugated foil 8 having small corrugations alternately. The large corrugated foil 7 and the small corrugated foil 8 are formed from a foil material having a plate thickness of 20 cm. The large corrugated foil 7 and the small corrugated foil 8 are connected at contact points by diffused junction after being overlapped and wound. Though not specifically illustrated, the small corrugated foil 8 is overlapped and wound, for example, three times, around the outermost circumference. The catalyst is carried on a surface of each corrugated foil 7, 8. Incidentally, the large corrugated foil 7 and the small corrugated foil 8 may be formed from a foil material having a plate thickness in a range of 18 $\mu$m to 22 $\mu$m (tolerance).

The large corrugated foil 7 and the small corrugated foil 8 are made of Cr of 19.0 to 21.0(wt %), Al of 5.0 to 6.0(wt %), Mn of 1.00 or less (wt %), Si of 1.00 or less (wt %), C of 0.01 or less (wt %), P of 0.04 or less (wt %), S of 0.03 or less (wt %), La of 0.06 to 0.12 (wt %), and Fe for the remaining.

Figures 2A, 2B:
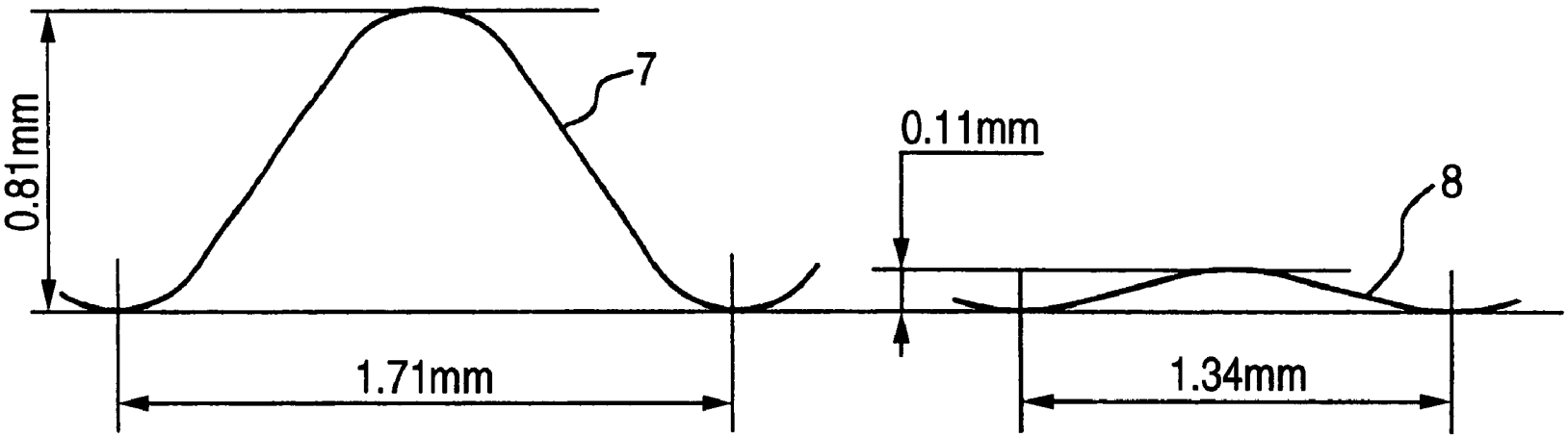
FIGS. 2A and 2B are diagrams showing combination shapes of a large corrugated foil and a small corrugated foil in this embodiment.

Herein, in order for the cell density to have 900 cells/square inches, a wave shape of the large corrugated foil 7 has a wave height of 0.81 mm and a pitch of 1.71 mm, as shown in FIG. 2A, and that of the small corrugated foil 8 has a wave height of 0.11 mm and a pitch of 1.34 mm, as shown in FIG. 2B. Incidentally, the cell density may be in a range of 810 cells/square inches to 990 cells/square inches.

The dimensional tolerance of wave height and pitch of the large corrugated foil 7 is ±0.05 mm, and the dimensional tolerance of pitch of the small corrugated foil 8 is ±0.05 mm. That is, the large corrugated foil 7 has a wave height from 0.76 to 0.86 mm and a pitch from 1.66 to 1.76 mm, and the small corrugated foil 8 has a pitch from 1.29 to 1.39 mm.

Figure 3:
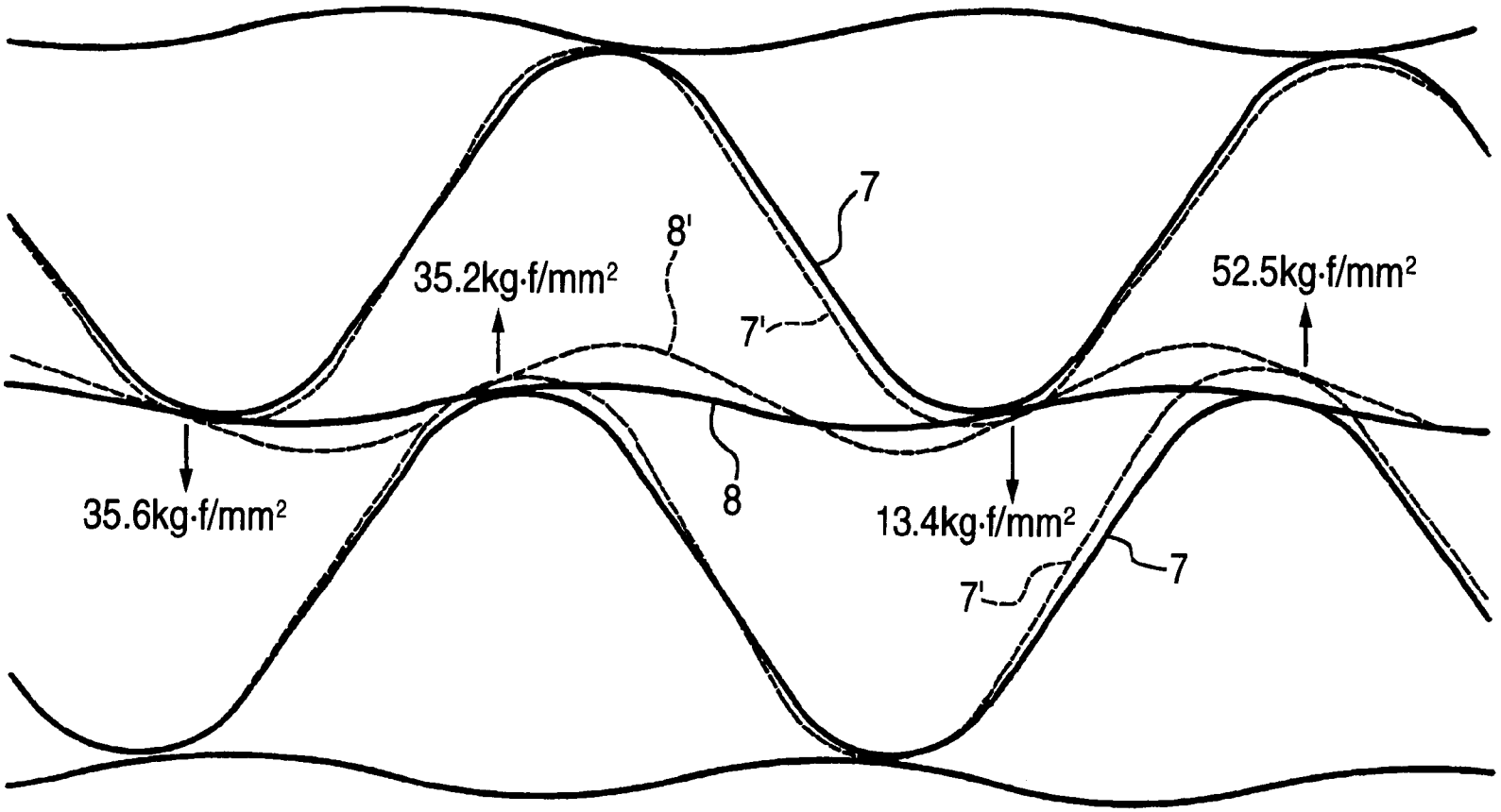
FIG. 3 is a view showing a thermal deformation state and a produced stress in combination of the corrugated foils as shown in FIG. 2.

FIG. 3 illustrates a state where the large corrugated foil 7 and the small corrugated foil 8 are overlapped in the solid line. Herein, it is assumed that the honeycomb structure 5 is subjected to a temperature of 900°, a case is simulated in which thermal expansion arises in a direction where the greatest stress is possibly produced by this heat, namely, adjacent large corrugated foils 7, 7 are opposed, as indicated by the broken line. The produced stress at the contact point in the simulation is varied depending on the contact position between the large corrugated foil 7' and the small corrugated foil 8', after the thermal expansion. The produced stress at the contact point is 35.6 kg·f/mm$^2$, 35.2 kg·f/mm$^2$, 13.4 kg·f/mm$^2$, and 52.5 kg·f/mm$^2$. An average value (average produced stress) thereof is as low as 34 kg·f/mm$^2$, as shown in FIG. 3.

Figure 4A:
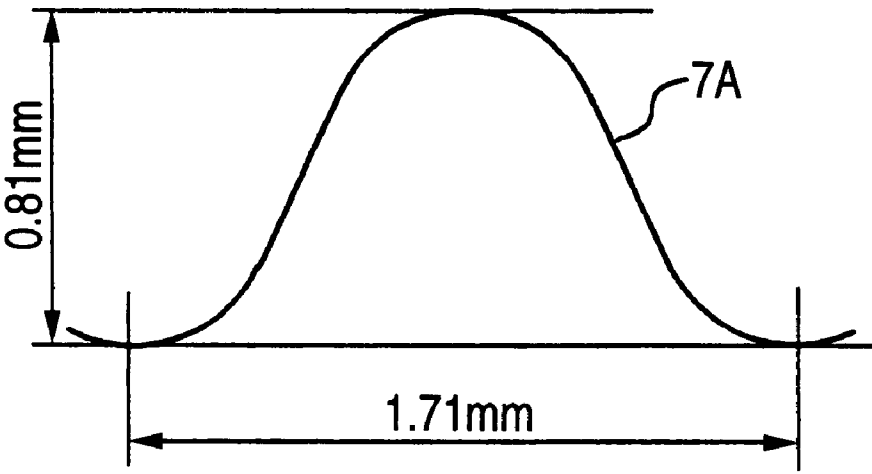
FIGS. 4A and 4B are diagrams showing combination shapes of other corrugated foils.
Figure 4B:
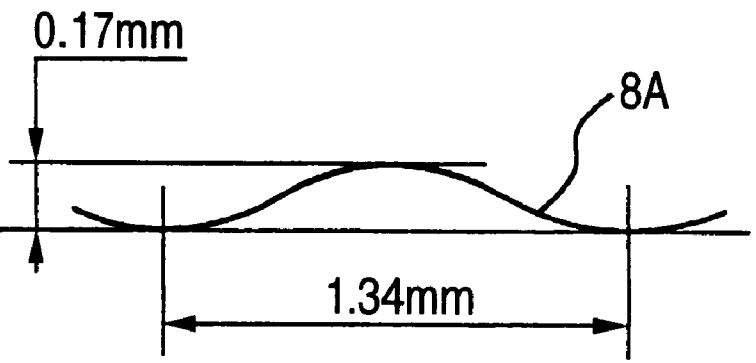
Figure 5:
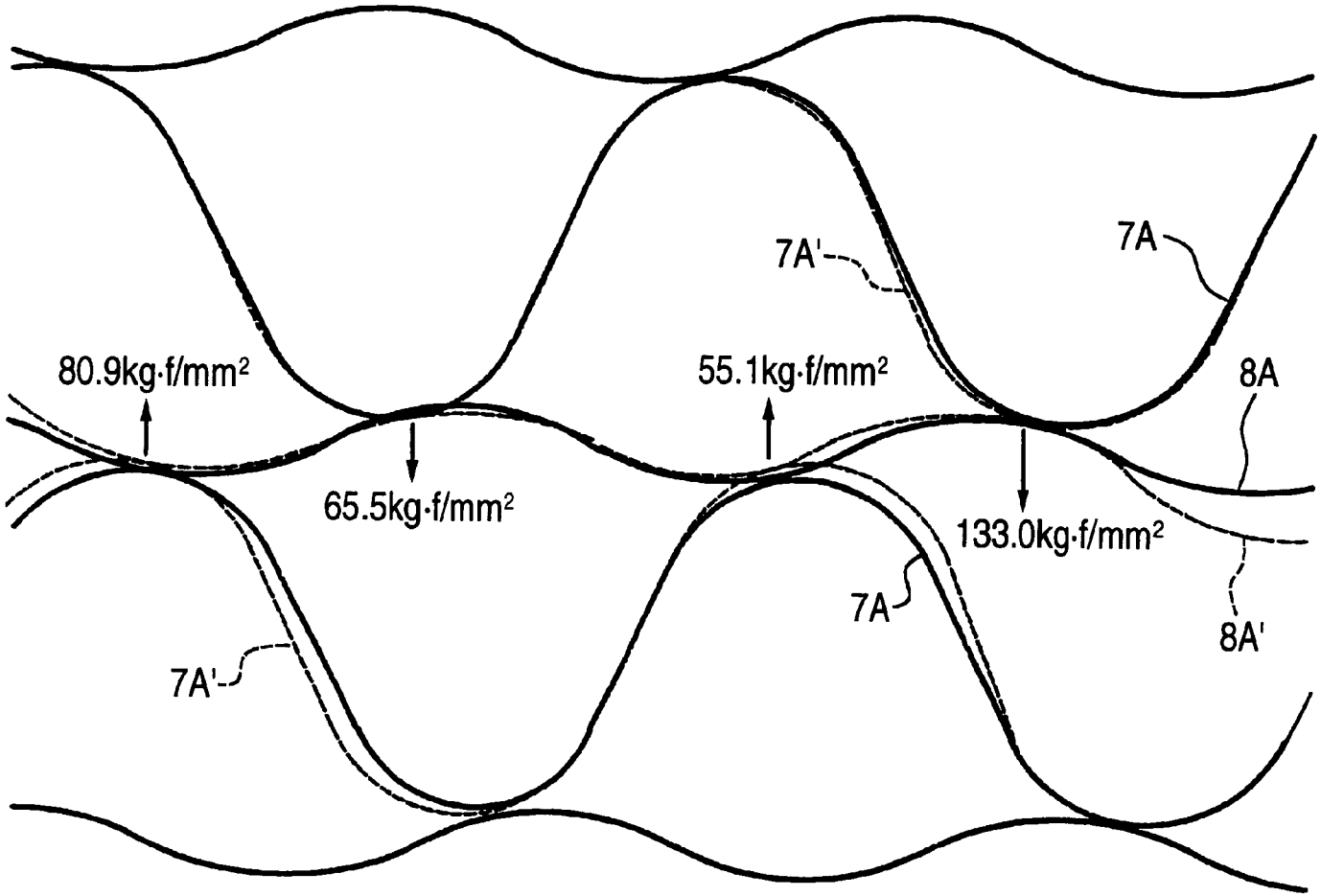
FIG. 5 is a view showing a thermal deformation state and a produced stress in the combination of corrugated foils as shown in FIG. 4.

In the case where a large corrugated foil 7A that has slightly different section but has the same wave height and pitch as the large corrugated foil 7, as shown in FIG. 4A, and a small corrugated foil 8A having a wave height of 0.17 mm and a pitch of 1.34 mm as shown in FIG. 4B are overlapped, when adjacent large corrugated foils 7, 7 are expanded in a direction where they are opposed to each other, as shown in FIG. 5. The produced stresses at the contact points between the large corrugated foil 7' and the small corrugated foil 8A' after expansion is 80.9 kg·f/mm$^2$, 65.5 kg·f/mm$^2$, 55.1 kg·f/mm$^2$, and 134.0 kg·f/mm$^2$, its average value being 84 kg·f/mm$^2$.

Figure 6:
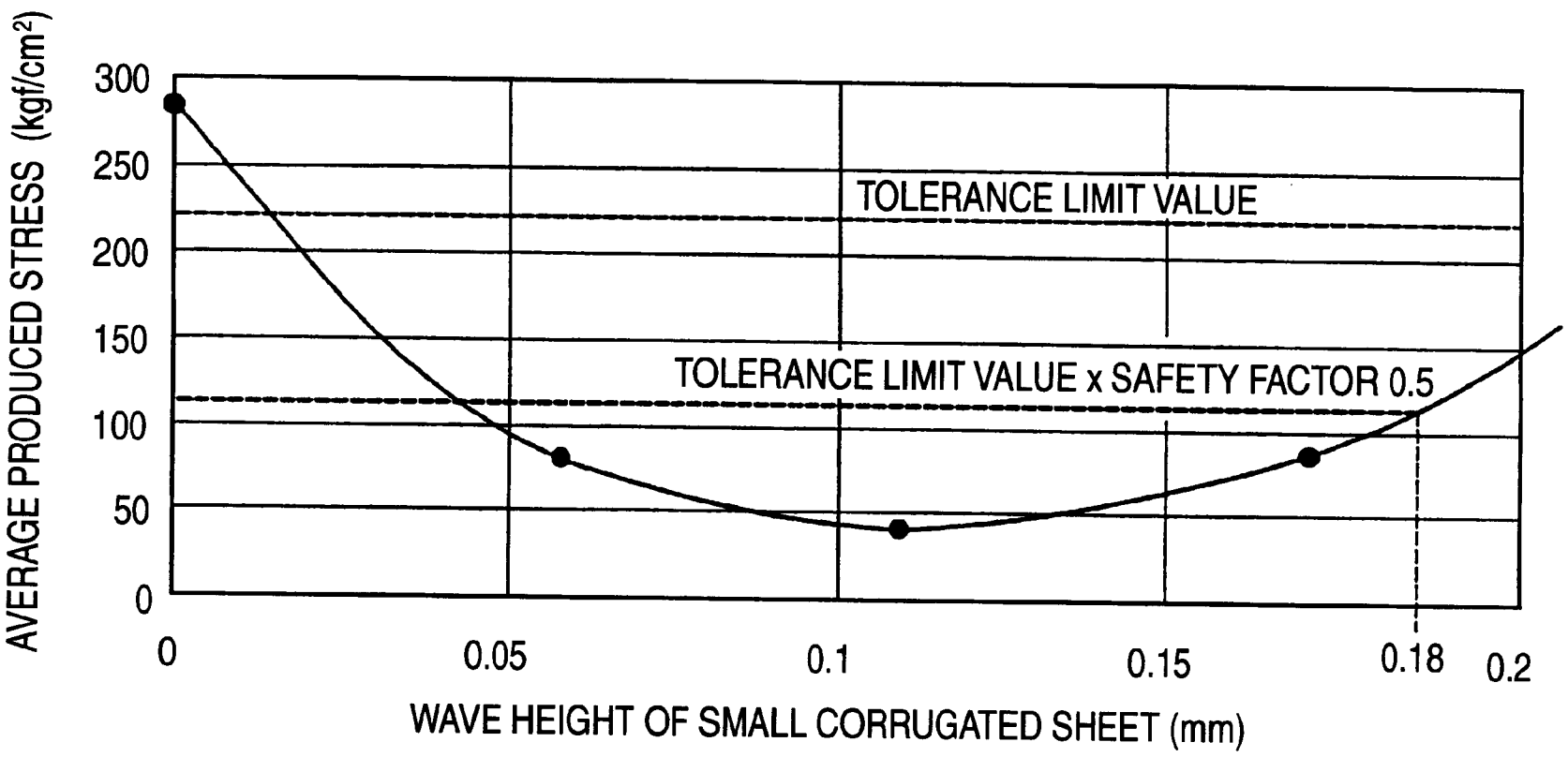
FIG. 6 is a diagram showing a variation of average produced stress when wave height of the small corrugated foil is changed.

FIG. 6 is a graph showing how the average produced stress is changed when the wave height is changed while the pitch of the small corrugated foil 8 is kept 1.34 mm.

The tensile strength of the foil material for each corrugated foil 7, 8 at a temperature of 900° C. is 2.2 kg·f/mm$^2$ (220 kg·f/cm$^2$), which is defined as the tolerance limit value. The average produced stress is set at a level of the tolerance limit value multiplied by a safety factor of 0.5, whereby the wave height of the small corrugated foil 8 is preferably from about 0.05 mm to 0.18 mm, as shown in FIG. 6.

Figure 7:
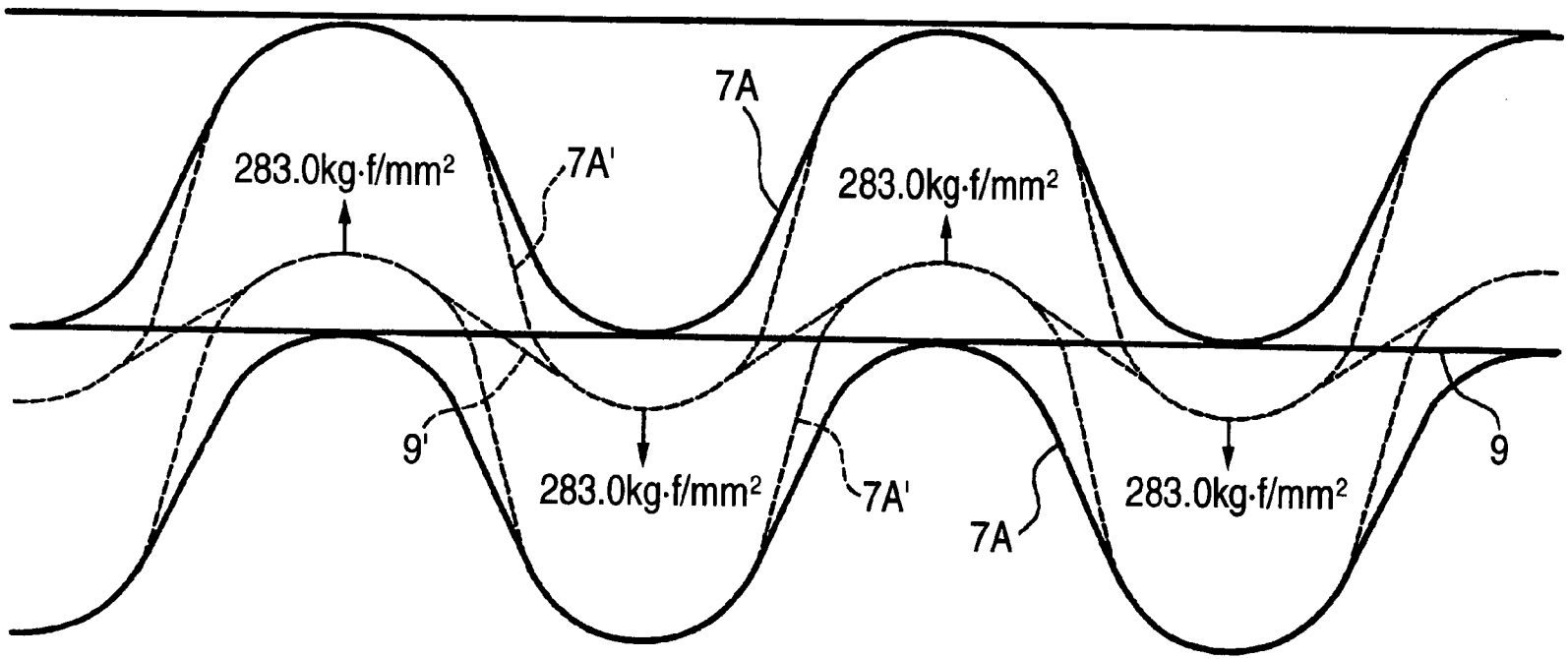
FIG. 7 is a view showing a thermal deformation state and a produced stress in the combination of a large corrugated foil and a flat plate as shown in FIG. 4.

As a comparative example, in the case where the large corrugated foil 7A having a plate thickness of 20 $\mu$m and the, same shape as, shown in FIG. 4A and a flat plate 9 having a plate thickness of 20 $\mu$m are overlapped, when adjacent large corrugated foils 7A, 7A are thermally expanded in a direction where they are opposed to each other, as shown in FIG. 7, the produced stress at each contact point between the large corrugated foil 7A' and the flat plate 9' after thermal expansion was as high as 283.0 kg·f/mm$^2$.

FIG. 8 shows the variations in the surface area and the heat capacity with respect to the settings of the plate thickness and the cell density for the corrugated foils (7, 8).

If the cell density is increased from 600 cells/square inches to 900 cells/square inches in the conventional plate thickness 30 $\mu$m used in the related art, the surface area is increased from 47 cm$^2$/cm$^3$ to 58 cm$^2$/cm$^3$, and the heat capacity is increased from 67 cal/° C. to 81 cal/° C.

On the contrary, in this embodiment, if the cell density is increased to 900 cells/square inches, with a plate 20 $\mu$m of thickness, the surface area is increased by about 26% from 47 cm$^2$/cm$^3$ to 59 cm$^2$/cm$^3$, and the heat capacity is decreased by 20% from 67 cal/° C. to 54 cal/° C.

Figure 9:
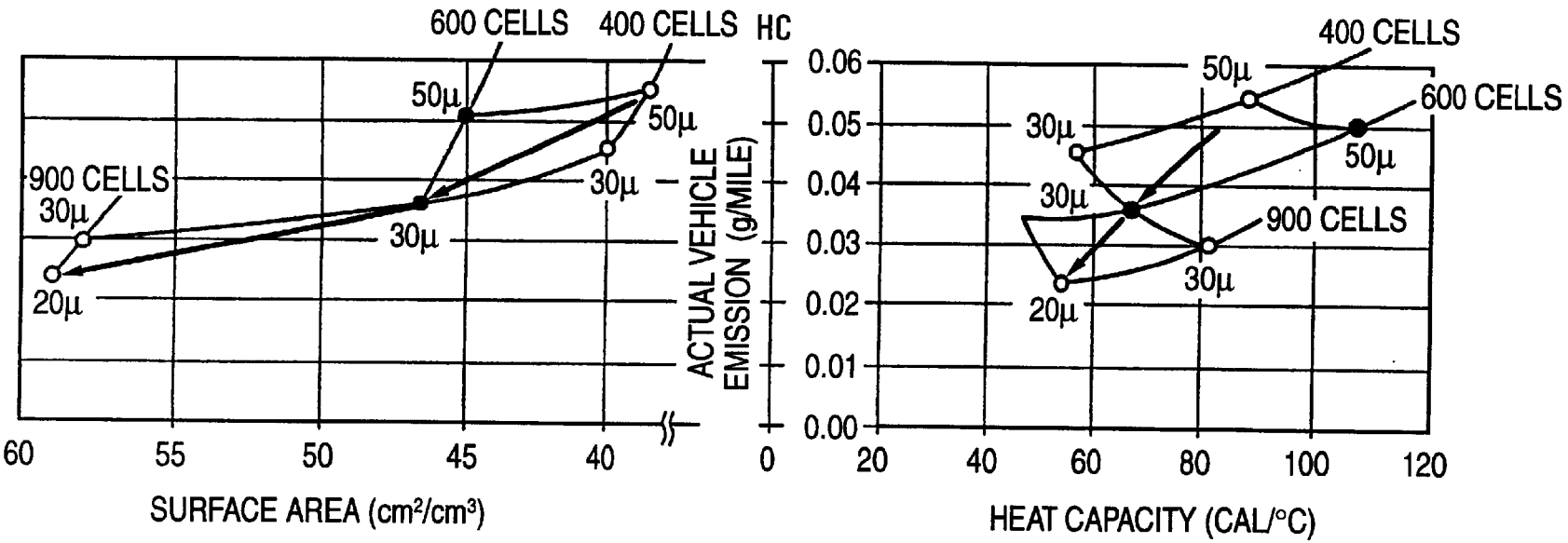
FIG. 9 is a graph showing evaluations for an actual vehicle in the purification of exhaust gas.

Thereby, the purification performance of emission (here HC) is improved as seen from the actual vehicle evaluations of FIG. 9.

In this embodiment as constituted in the above manner, there is provided the metal substrate 1 in which the honeycomb structure 5 including the large corrugated foil 7 and the small corrugated foil 8 overlapped and wound is held within the outer casing 2. The plate thickness of both the corrugated foils is in a range of 18 $\mu$m to 22 $\mu$m, preferably 20 $\mu$m, and the cell density of the honeycomb structure is in a range of 810 cells/square inches to 990 cells/square inches, preferably 900 cells/square inches. As compared with the metal substrate according to the related art having the plate thickness of 30 $\mu$m and the cell density of 600 cells/square inches, the surface area of the catalyst contact with the exhaust gas is conspicuously increased and the heat capacity is decreased. Accordingly, the increased surface area and the decreased heat capacity are involved to remarkably enhance the exhaust emission purification performance from the early stage of starting the operation, and make lighter the carrier.

Since the large corrugated foil and the small corrugated foil in the honeycomb structure are connected by diffused junction, Al and Cr in the foil material of each corrugated foil are not diluted and decrease of the resistance to oxidation is not caused. Accordingly, the high temperature durability is maintained, notwithstanding the plate thickness in a range of 18 μm to 22 cm.

Moreover, the large corrugated foil 7 has a wave height of 0.81 mm and a pitch of 1.71 mm, and the small corrugated foil 8 has a predetermined wave height (about 0.05 mm to 0.18 mm, particularly 0.11 mm) and a pitch of 1.34 mm, whereby the produced stress upon thermal expansion is at lower level, and the high temperature durability is further improved.

Also, since a plurality of small corrugated foils 8 are overlapped and wound three times around the outermost circumference of the honeycomb structure 5, the rigidity of the outer circumference is high, in spite of the plate thickness of as thin as 18 μm to 22 μm (20 μm), and the strength of the brazed portion with the outer casing 2 is increased.

The brazing between the outer casing 2 and the honeycomb structure 5 is made near the center with the gap D from the back end of the honeycomb structure 5 on the rear-half side of the outer casing 2 in a flow direction of exhaust gas and both the outer casing 2 and the honeycomb structure 5 are at substantially even temperature and connected in the area not subjected to the heat radiation on the back end face. Therefore the thermal stress between the outer casing 2 and the honeycomb structure 5 is relieved.

In this embodiment, the round type metal substrate that is cylindrical in the outer shape has been described above. However, the present invention is not limited to such round type, and may be also applied to the metal substrate of so-called racing track type.

As described above, the present invention provides a metal substrate having an outer casing and a honeycomb structure formed by overlapping and winding a large corrugated foil and a small corrugated foil, the honeycomb structure held in the outer casing. The large corrugated foil and the small corrugated foil have thickness in a range of 18 μm to 22 μm, preferably 20 μm. The honeycomb structure has 900 cells/square inches in cell density. Thereby, the surface area of the catalyst contact with the exhaust gas is conspicuously increased and the heat capacity is decreased. Consequently, there is the effect that the exhaust emission purification performance is remarkably enhanced from the early stage of starting the operation.

Also, since the large corrugated foil and the small corrugated foil in the honeycomb structure are connected by diffused junction, the resistance to oxidation is not lowered, whereby the high temperature durability is maintained, notwithstanding the plate thickness of as thin as 18 μm to 22 μm (20 μm).

In particular, the large corrugated foil has a wave height in a range of 0.76 mm to 0.86 mm and a pitch in a range of 1.66 mm to 1.76 mm. The small corrugated foil has a wave height in a range of 0.05 mm to 0.18 mm and a pitch in a range of 1.29 mm to 1.39 mm. Whereby, the produced stress in each corrugated foil upon thermal expansion is suppressed to the lower level, and the high temperature durability is further improved.

Moreover, the small corrugated foil is overlapped and wound around an outermost circumference of the honeycomb structure multiple times, for example three times. Whereby resulting in the advantages that the rigidity of the outer circumference is enhanced and the strength of the brazed portion with the outer casing is increased.

In brazing the honeycomb structure and the inner circumferential face of the outer casing, the brazing foil is disposed in the area spaced away a predetermined distance from the back end face of the honeycomb structure on the rear-half side in a flow direction of exhaust gas, whereby the thermal stress between the outer casing and the honeycomb structure is relieved.

Moreover, the outer casing is formed with a radially outwardly swollen bead around the entire circumference on the opposite side of the rear end face of the honeycomb structure, with the brazing foil before brazing sandwiched, whereby the rising brazing filler due to heating at the time of brazing is blocked by the bead portion.

What is claimed is:

1. A metal substrate comprising:

an outer casing; and a honeycomb structure formed by overlapping and winding a large corrugated foil and a small corrugated foil, the honeycomb structure held in the outer casing, wherein the large corrugated foil and the small corrugated foil have thickness in a range of 18 μm to 22 μm; and wherein the honeycomb structure has cell density in a range of 810 cells/square inches to 990 cells/square inches.

2. The metal substrate according to claim 1, wherein, the large corrugated foil and the small corrugated foil in the honeycomb structure are connected by diffused junction.

3. The metal substrate according to claim 1, wherein the large corrugated foil has a wave height in a range of 0.76 mm to 0.86 mm and a pitch in a range of 1.66 mm to 1.76 mm; and wherein the small corrugated foil has a wave height in a range of 0.05 mm to 0.18 mm and a pitch in a range of 1.29 mm to 1.39 mm.

4. The metal substrate according to claim 1, wherein the small corrugated foil is overlapped and wound around an outermost circumference of the honeycomb structure multiple times.

5. The metal substrate according to claim 1, wherein the honeycomb structure is brazed with an inner circumferential face of the outer casing by a brazing foil disposed in an area spaced away a predetermined distance from a back end face of the honeycomb structure on a rear-half side in a flow direction of exhaust gas.

6. The metal substrate according to claim 5, wherein the outer casing is formed with a radially outwardly swollen bead around the entire circumference of the outer casing on an opposite side to the rear end face of the honeycomb structure, with the brazing foil before brazing sandwiched.

7. The metal substrate according to claim 1, wherein the large corrugated foil and the small corrugated foil have 20 μm in thickness; and wherein the honeycomb structure has 900 cells/square inches in cell density.

* * * * *